US008159448B2

(12) United States Patent
Barrow

(10) Patent No.: US 8,159,448 B2
(45) Date of Patent: Apr. 17, 2012

(54) TEMPERATURE-COMPENSATION NETWORKS

(75) Inventor: Jeffrey G. Barrow, Tuscon, AZ (US)

(73) Assignee: Analog Devices, Inc., Norwood, MA (US)

( * ) Notice: Subject to any disclaimer, the term of this patent is extended or adjusted under 35 U.S.C. 154(b) by 665 days.

(21) Appl. No.: 12/317,108

(22) Filed: Dec. 19, 2008

(65) Prior Publication Data

US 2010/0156871 A1 Jun. 24, 2010

(51) Int. Cl.
*G09G 3/36* (2006.01)

(52) U.S. Cl. ..... 345/101; 327/512

(58) Field of Classification Search ..... 345/101; 374/163–175; 349/72, 199; 327/83, 138, 327/262, 371, 378, 512–513
See application file for complete search history.

(56) References Cited

U.S. PATENT DOCUMENTS

| | | | | | |
|---|---|---|---|---|---|
| 4,716,315 | A | * | 12/1987 | Bell | 327/513 |
| 4,914,317 | A | * | 4/1990 | Agiman | 327/108 |
| 5,523,714 | A | * | 6/1996 | Topp et al. | 327/427 |
| 5,696,387 | A | | 12/1997 | Choi et al. | 257/57 |
| 5,923,208 | A | * | 7/1999 | Tasdighi et al. | 327/512 |
| 6,078,208 | A | * | 6/2000 | Nolan et al. | 327/512 |
| 6,089,751 | A | | 7/2000 | Conover et al. | 374/183 |
| 6,256,006 | B1 | | 7/2001 | Yamamoto et al. | 345/101 |
| 6,329,975 | B1 | | 12/2001 | Yamaguchi | 345/99 |
| 6,433,769 | B1 | | 8/2002 | Cato | 345/101 |
| 6,545,292 | B1 | | 4/2003 | Kim | 257/59 |
| 6,795,052 | B2 | | 9/2004 | Lin et al. | 345/101 |
| 6,803,899 | B1 | | 10/2004 | Masasumi et al. | 345/101 |
| 6,831,626 | B2 | | 12/2004 | Nakamura et al. | 345/101 |
| 7,038,654 | B2 | | 5/2006 | Naiki et al. | 345/101 |
| 7,109,990 | B1 | | 9/2006 | Oler et al. | 345/428 |
| 7,307,468 | B1 | * | 12/2007 | Vasudevan | 327/539 |
| 7,532,056 | B2 | * | 5/2009 | Seo | 327/512 |
| 7,768,342 | B1 | * | 8/2010 | McMahill | 327/538 |
| 2008/0062100 | A1 | * | 3/2008 | Hong et al. | 345/87 |

* cited by examiner

*Primary Examiner* — Amr Awad
*Assistant Examiner* — Liliana Cerullo
(74) *Attorney, Agent, or Firm* — Koppel, Patrick, Heybl & Philpott

(57) ABSTRACT

Temperature-compensation network embodiments are provided to generate compensation signals which may be useful in improving the performance of a variety of important systems. An embodiment includes a limit current mirror configured to provide a limit current, a current generator to provide a slope current whose magnitude varies with temperature, and an output current mirror positioned to receive the limit current and the slope current and configured to provide a compensation current. In addition, a floating voltage reference is provided for use in various networks which include the temperature-compensation networks. The temperature-compensation networks may be used to improve performance in systems such as a panel driver which provides turn-on and turn-off gate voltages to transistors in liquid crystal displays.

14 Claims, 4 Drawing Sheets

TEMPERATURE-COMPENSATION NETWORKS

BACKGROUND OF THE INVENTION

1. Field of the Invention

The present invention relates generally to temperature-compensation structures.

2. Description of the Related Art

Efficient temperature-compensation networks can provide considerable value by improving the performance of a variety of important systems. One system example is a liquid crystal display that is formed with active arrays of thin film transistors. Display panels for this type of display are typically referred to as thin film transistor, liquid crystal display panels or TFT LCD panels. These panels include a large number of display pixels that are generally arranged in rows and columns between a pair of glass substrates which are each covered with a sheet of polarizer film.

Each pixel actually comprises three color subpixels which are each formed by positioning a color filter (either red, green or blue) and a transparent pixel electrode on opposite inner faces of the glass substrates, filling the space between with a liquid crystal, and coupling the drain of a TFT to a storage capacitor via the pixel electrode. At an operational refresh rate (e.g., 60 Hz), an activation voltage is applied to the gate of the TFT while an image signal is applied to its source.

An image voltage is thus applied to the liquid crystal and momentarily held by the storage capacitor. In response to the image voltage, the liquid crystal rotates the polarization of passing light (originating, for example, in a backlight) which, in combination with the polarization of the polarizer films, adjusts the brightness of the light emanating from the respective subpixel. An exemplary TFT LCD panel may be arranged with 768 rows and 1024 columns so that it comprises 2,359,296 subpixels and an equal number of TFT's.

Unfortunately, the performance of TFT LCD panels degrades at temperature extremes because important display parameters (e.g., TFT threshold voltage and liquid crystal viscosity) vary over temperature. This temperature degradation can be significantly reduced with the information provided by temperature-compensation networks whose configuration preferably facilitates their inclusion within panel integrated circuits.

BRIEF SUMMARY OF THE INVENTION

The present disclosure is generally directed to temperature-compensation networks. The drawings and the following description provide an enabling disclosure and the appended claims particularly point out and distinctly claim disclosed subject matter and equivalents thereof.

DETAILED DESCRIPTION OF THE INVENTION

Figure 1:
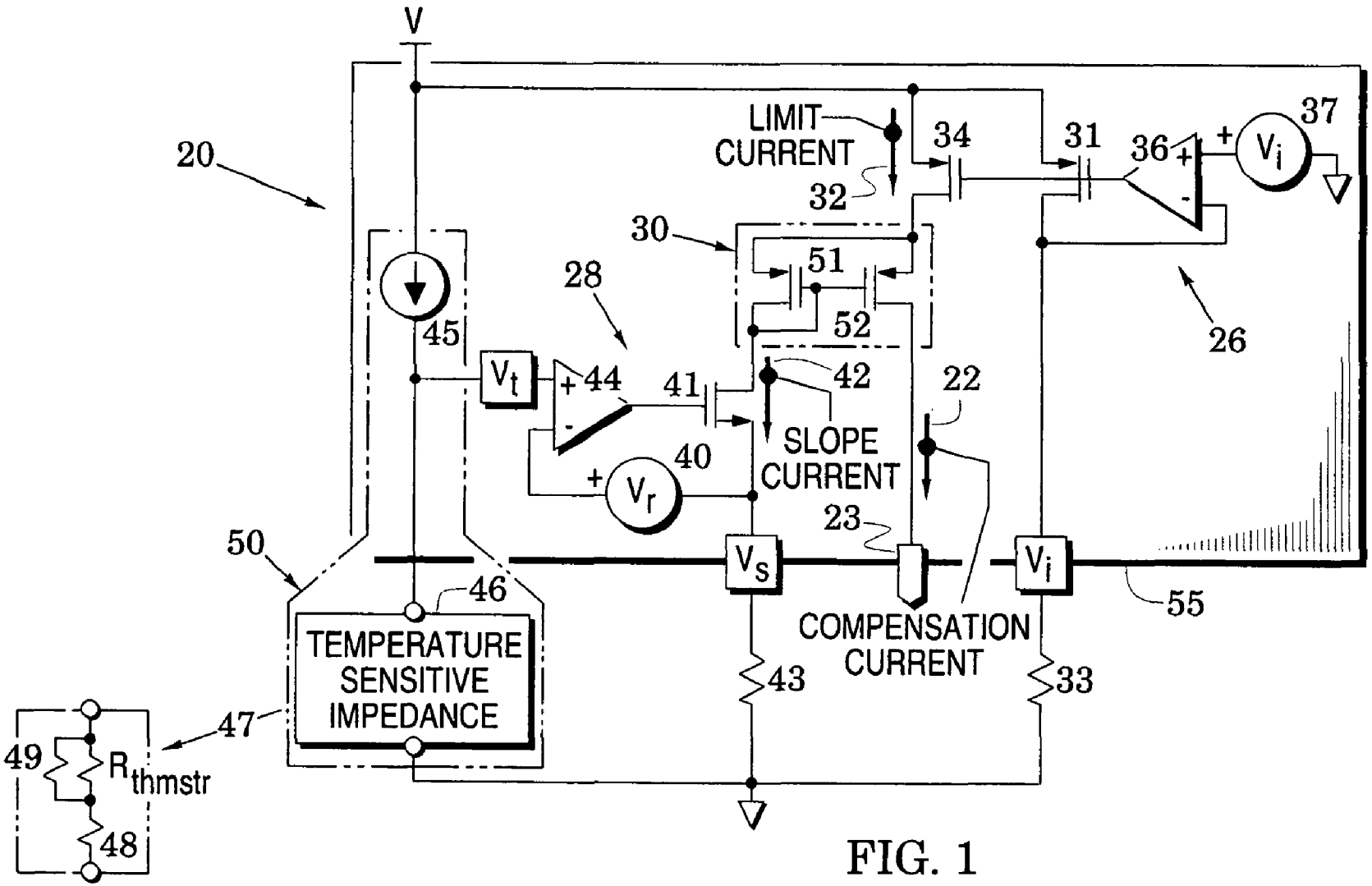
FIG. 1 is a schematic that illustrates a temperature-compensation network embodiment of the present disclosure.
Figure 2:
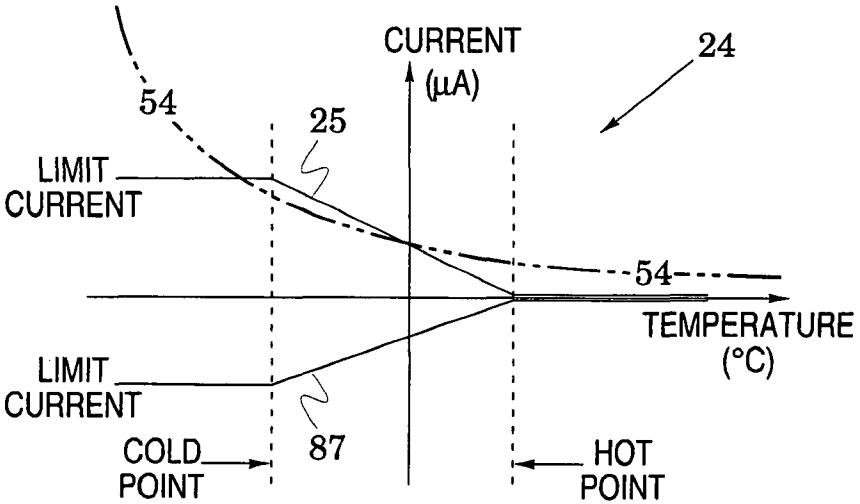
FIG. 2 is a graph that illustrates selectable temperature response of a compensation current of the network of FIG. 1.
Figure 3:
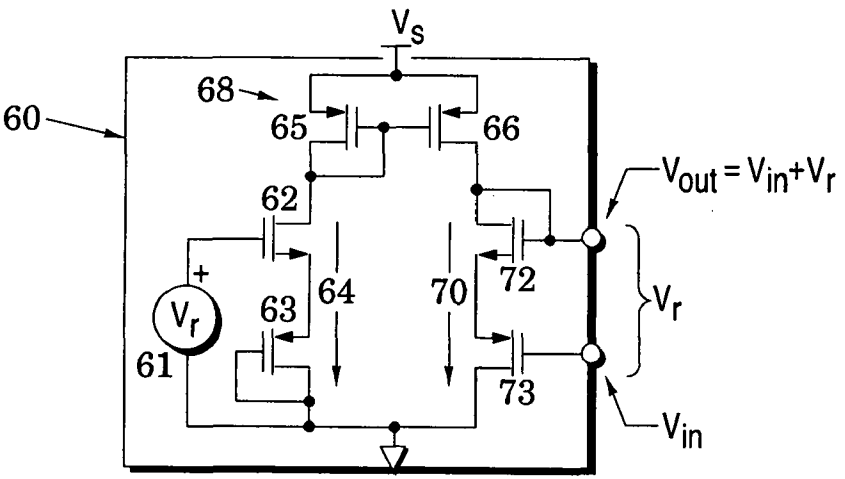
FIG. 3 is a schematic that illustrates an embodiment of a floating voltage reference in the network of FIG. 1.
Figure 4:
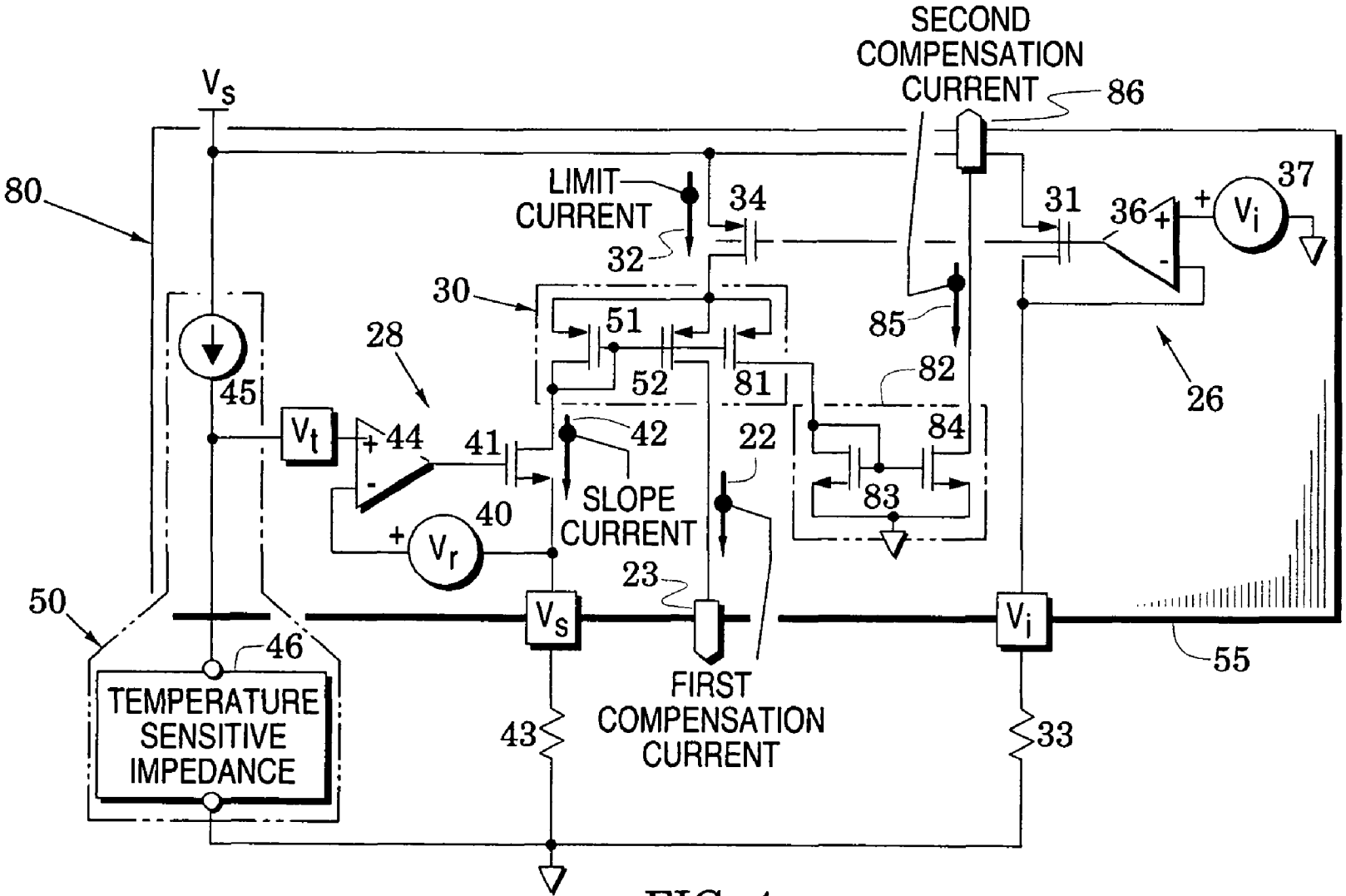
FIG. 4 is a schematic that illustrates another temperature-compensation network embodiment.

FIGS. 1, 2 and 4 illustrate structure and performance of temperature-compensation network embodiments that generate compensation signals which may be useful in improving the performance of a variety of important systems. FIG. 3 illustrates a floating voltage reference which may be used in a variety of networks such as those of FIGS. 1 and 4. The temperature-compensation network of FIG. 4 may be used to improve temperature performance in a panel driver of FIG. 5 which provides turn-on and turn-off gate voltages to transistors in liquid crystal displays. The transfer function of the temperature-compensation networks can be easily modified by selection of a minimal set of elements (e.g., a temperature transducer and two resistors).

In particular, FIG. 1 illustrates a temperature-compensation network 20 that can generate a compensation current 22 (at an output port 23) with an amplitude that responds in a selectable way to temperature. For example, the graph 24 of FIG. 2 illustrates a plot 25 of the compensation current 22 that is substantially zero for temperatures above a "hot point" temperature, increases at a selected slope as the temperature drops below the hot point, and then remains substantially fixed as the temperature drops below a "cold point" temperature. As subsequently described, the hot point, the slope and the cold point can be selectively adjusted.

In detail, the network 20 of FIG. 1 includes a limit current mirror 26, a current generator 28, and an output current mirror 30. The limit current mirror has a transistor 31 that can be diode-coupled to thereby set a current through a limit resistor 33. A mirror transistor 34 is then gate-coupled to the diode-coupled transistor 31 to thereby mirror a limit current 32 to the output current mirror 30.

In another network embodiment, a differential amplifier 36 can be inserted between the drain and gate of the transistor 31 with the non-inverting input of the amplifier biased with an input voltage $V_i$ from a voltage reference 37. The high gain of the differential amplifier forces the voltage at the top side of the limit resistor 33 to substantially be the input voltage $V_i$. To enhance efficiency of the network 20, the gate width of the transistor 31 is preferably reduced from that of the mirror transistor 34 to thereby reduce the amplitude of the current through the limit resistor 33.

The current generator 28 is formed with a floating voltage reference 40 and a slope transistor 41 that are both coupled to the top of a slope resistor 43. The slope transistor 41 is driven by a differential amplifier 44 that responds to the difference between a reference voltage $V_r$ of the voltage reference 40 and a temperature-sensitive voltage $V_t$. When the temperature-sensitive voltage $V_t$ is less that the voltage reference $V_r$, the differential amplifier cannot generate a gate voltage sufficient to turn on the slope transistor 41. When the temperature-sensitive voltage $V_t$ exceeds the threshold voltage of the slope transistor 41, however, this transistor turns on and drives a slope current 42 through the slope resistor 43. Because of the high gain of the differential amplifier 41, its input terminals can be considered to have equal potentials so that a slope voltage $V_s$ across the slope resistor 43 closely approximates $V_t+V_r$.

The temperature-sensitive voltage $V_t$ can be generated with any of a variety of temperature transducers 50. An exemplary transducer is formed by passing the current (e.g., a current on the order of 10 microamperes) of a current source 45 through a temperature-sensitive impedance 46. Although the impedance 46 can simply be a suitably-chosen thermistor, example arrow 47 indicates it may also be formed with a thermistor $R_{thmtr}$ and at least one resistor coupled in a selected one of series and parallel arrangements with the thermistor. For example, a resistor 48 can be inserted in series with the thermistor and/or a resistor 49 can be inserted in parallel with the thermistor. Accordingly, desired shifting and/or linearizing effects may be applied to the temperature response of the thermistor.

The output current mirror 30 is arranged to receive the limit current 32 from the mirror transistor 34 of the limit current mirror 26. The mirror 30 is formed with a diode-coupled transistor 51 that receives the slope current 42 from the current generator 28 and a mirror transistor 52 that is gate-coupled to the diode-coupled transistor. As shown in FIG. 1, the mirror transistor 52 has a first current terminal coupled to receive the limit current 32 from the limit current mirror 26 and a second current terminal coupled to provide the compensation current 22 at the output port 23. To enhance efficiency of the network 20, the gate width of the diode-coupled transistor 51 is preferably reduced from that of the mirror transistor 52 to thereby reduce the amplitude of the slope current 42 through the slope resistor 43.

In operation, of the output current mirror 30, the diode-coupled transistor 51 receives the slope current 42 and, in response, the mirror transistor 52 mirrors the compensation current 22 to the output port 23. As temperature drops, the temperature-sensitive voltage $V_t$ increases which causes the slope transistor 41 to increase the slope current 42. In response, the output current mirror 30 mirrors an increasing compensation current 22 to the output port 23.

The amplitude of the compensation current 22 cannot, however, exceed that of the limit current 32 that is provided to the output current mirror 30 by the current generator 26. Accordingly, the amplitude of the compensation current will increase with falling temperature until it substantially reaches the amplitude of the limit current after which the compensation current amplitude will remain constant.

FIG. 2, for example, shows an exemplary resistance versus temperature curve 54 that might be generated by suitable selection of elements of the temperature-sensitive circuit 46 of FIG. 1. At high temperatures, the resistance of the curve 54 will not be sufficient to cause the temperature-sensitive voltage $V_t$ of FIG. 1 to exceed the reference voltage $V_r$ so that the slope current 42 and the compensation current are both zero. As the temperature drops, the resistance of the curve 54 rises so that the temperature-sensitive voltage $V_t$ exceeds the reference voltage $V_r$ sufficiently to generate an increasing slope current 42 which causes the output current mirror 30 to mirror an increasing compensation current as indicated by the compensation current plot 25 in FIG. 2. When the amplitude of the compensation current reaches that of the limit current, (32 in FIG. 1), the output current mirror 30 can no longer support an increasing current so that compensation current plot 25 remains flat with further reduction in the temperature as shown in FIG. 2.

FIG. 1 indicates that a particular temperature-compensation network embodiment may be formed by carrying the limit resistor 33, the slope resistor 43, and the temperature-sensitive circuit 46 on a printed-circuit board (not shown) and housing the remaining network elements in an integrated circuit that may be carried on the printed-circuit board and that is represented in FIG. 1 by the rectangle 55. This arrangement facilitates selection and installation of a temperature-sensitive circuit 46 that has been selected to position the hot point in FIG. 2 at a desired temperature. The slope resistor 43 can then be selected and installed to obtain a desired slope of the compensation current plot 25 of FIG. 2 between the hot point and the cold point. Finally, the limit resistor 33 can be selected and installed to position the cold point at a desired temperature.

Before describing an exemplary temperature-compensation application of the network 20, attention is directed to FIG. 3 which illustrates an embodiment 60 of the floating voltage reference 40 of FIG. 1. This embodiment includes an input diode-coupled transistor 62 and an input transistor 63 that is coupled to drive a input current 64 through the input diode-coupled transistor in response to the reference voltage $V_r$ of a voltage reference 61 that is applied to the input transistor's gate.

A current mirror 68 is formed with a diode-coupled transistor 65 and an output transistor 66 that is gate-coupled to the diode-coupled transistor. The diode-coupled transistor carries the input current 64 and mirrors an output current 70 through an output diode-coupled transistor 72 and an output transistor 73. Input transistor 62 and output transistor 73 are transistors of a first polarity and the input diode-coupled transistor 63 and the output diode-coupled transistor 72 are transistors of a second different polarity. The gates of the output diode-coupled transistor 72 and the output transistor 73 are available to provide a floating voltage reference $V_r$.

In an embodiment of the voltage reference 60, each of the transistors 62, 63 and 64 is matched (i.e., identical construction) to a respective one of the transistors 72, 73 and 74. The input current 64 is generated because the input reference voltage $V_r$ is configured to be greater than the sum of the threshold voltages of transistors 62 and 63. The mirrored output current 70 then lifts the source of the output transistor 73 which turns it on to thereby establish the output current 70 that substantially equals the input current 64.

The gate of the output transistor 73 is a high-impedance port whose voltage level can be set with any input voltage $V_{in}$ that is above ground but is less than the sum of the threshold voltages of transistors 66, 72 and 73. Because of the transistor match mentioned above, the voltage difference between the gates of transistors 72 and 73 will be the same as the reference voltage $V_r$ that exists between the gates of transistors 62 and 63 so that the voltage at the gate of transistor 72 is $V_{in}+V_r$. It is noted that sizing of the transistors may be altered to realize various other embodiments of the floating voltage reference 60.

When the embodiment 60 of FIG. 3 is used in FIG. 1, the gate of the output transistor 73 is coupled to the source of the slope transistor 41. The gate of the output diode-coupled transistor 72 is then coupled to the high-impedance inverting input of the differential amplifier 44 to establish the reference voltage between the source of the slope transistor 41 and the inverting input. In an embodiment of the voltage reference 60 of FIG. 3, the voltage reference 61 may be configured as a band-gap reference so that the voltage of the voltage reference 40 in FIG. 1 is on the order of 1.2 volts. The voltage reference 37 may also be configured as a band-gap reference so that the input voltage $V_i$ is also on the order of 1.2 volts.

Another temperature-compensation network 80 is shown in FIG. 4. This network includes elements of the network 20 of FIG. 1 with like elements indicated by like reference numbers. In addition, however, the network 80 adds another mirror transistor 81 (similar to the mirror transistor 52) to the current mirror 30 and also adds a current mirror 82 that is driven by the mirror transistor 81 to thereby supply a second compensation current at a second output port 86.

The current mirror 82 includes a diode-coupled transistor 83 that is driven by the mirror transistor 81 and further includes a mirror transistor 84 that is gate-coupled to the diode-coupled transistor 83 to mirror its current into the second compensation current 85 at the output port 86. To enhance efficiency of the current mirror 82, the gate widths of the transistors 81 and 83 are preferably reduced from that of the mirror transistor 84 to thereby reduce the current needed to generate the second compensation current.

The graph 24 of FIG. 2 also includes a plot 87 of the second compensation current 85. The plot 87 is substantially the inverse of the plot 25 which represented the first compensation current 22 of FIG. 4. Although the amplitude of the two plots are shown to be equal, they may be adjusted to differ as described above. It is noted that the absolute size of transistors (e.g., transistors 34, 51, 52 81, 83 and 84) in the networks 20 and 80 of FIGS. 1 and 4 may be selected in accordance with their currents and voltages and that their relative size may be adjusted to reduce current drain and enhance accuracy and matching.

The temperature-compensation networks of the disclosure find use in a variety of systems. An exemplary system is that of a TFT-LCD panel which arranges display pixels in rows and columns of a panel matrix. At each row-column intersection, three thin film transistors are arranged to drive respective liquid crystal elements to respectively determine the brightness of red, green and blue pixel components at that intersection. Each of the three components can thus be considered to be generated at a sub-pixel.

In an exemplary active matrix display operation, the transistor gates in a selected matrix row are briefly biased on with a high gate voltage (e.g., 25 volts) while the transistor gates of all other matrix rows are biased off with a low gate voltage (e.g., −10 volts). With the gates of that row biased on, column image drivers each apply a respective analog image voltage to the drain of a corresponding transistor in the selected row to thereby establish the color brightness of an associated sub-pixel.

The analog drain voltage is typically derived from an eight-bit signal so that the color at the associated pixel is selectable over a 24-bit range. This process is repeated for all rows of the display in order to complete a refresh cycle for the total display. Each transistor generally drives a capacitor which holds the applied data voltage until the next refresh cycle. Several refresh cycles (e.g., 60) are completed each minute.

As the temperature decreases, the threshold voltage of the thin film transistors changes which degrades the accuracy of their response to the column image signals. In addition, crystal viscosity increases so that subpixel response time degrades. These effects may substantially degrade the visual quality of the display. It has been found that this degradation can be substantially reduced by properly varying the amplitudes of high and low gate voltages that are used to bias on and off the transistor gates in a selected matrix row.

Figure 5:
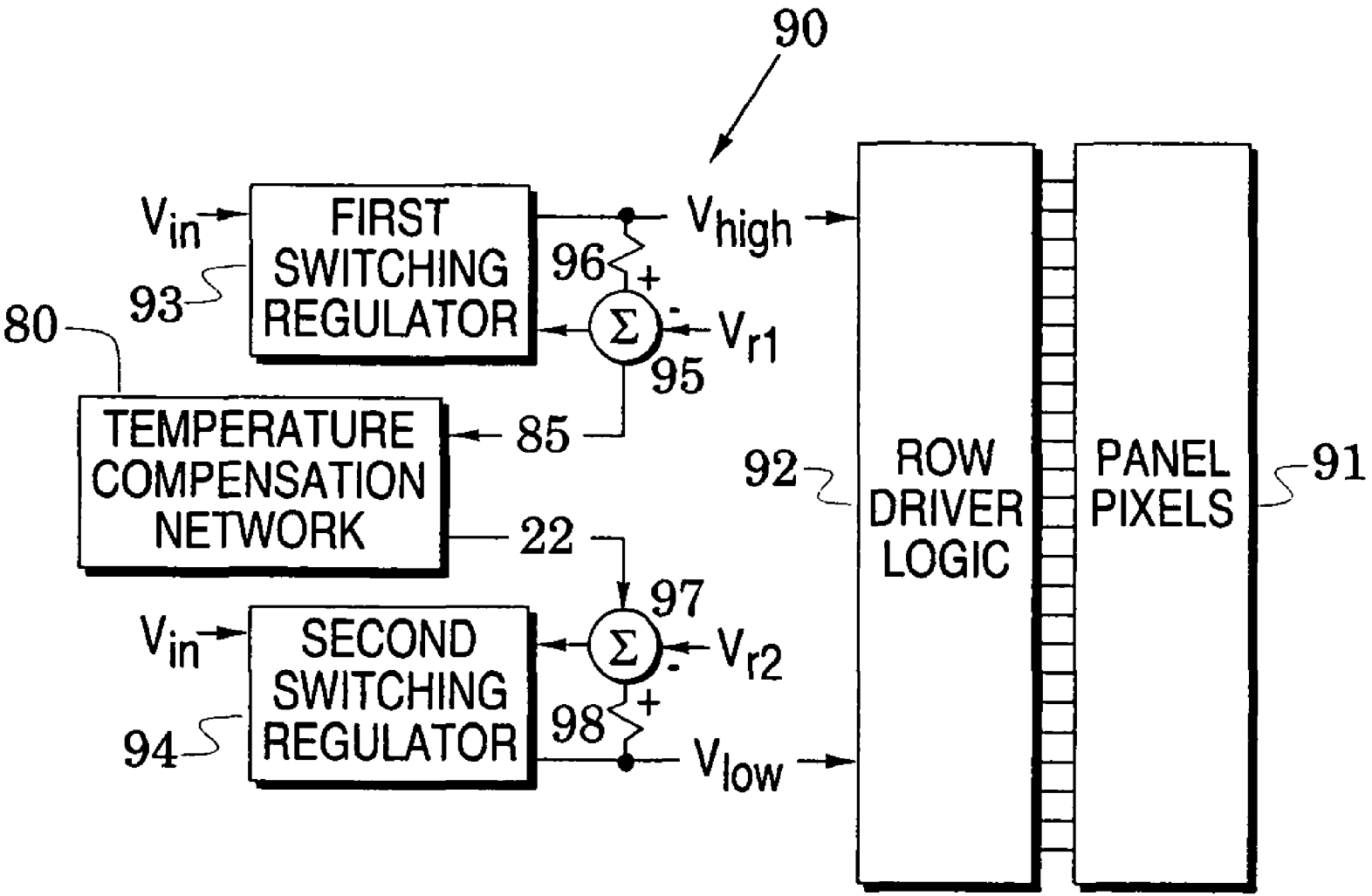
FIG. 5 is a block diagram of a liquid crystal display system which includes the network of FIG. 4.

This process is accomplished in the panel driver 90 of FIG. 5 that provides high gate voltage $V_{high}$ and a low gate voltage $V_{low}$ to the row driver logic 91 of a liquid crystal display. The display includes panel pixels 92 that are formed with rows of sub-pixel thin film transistors. The row driver logic is configured to apply the high gate voltage $V_{hig}$ to turn on transistors in sequentially-selected ones of the rows while applying the low gate voltage $V_{low}$ to turn off the transistors in others of the rows.

In the panel driver 90, the high and low gate voltages are respectively provided to the row driver logic by first and second switching regulators 93 and 94 which may be realized with various conventional switching regulator structures (e.g., charge pump regulator and buck-boost switching regulator) that provide selectable output voltages in response to an input voltage $V_{in}$.

The first switching regulator 93 includes a differencer 95 that provides a feedback error signal as the difference between the high gate voltage $V_{high}$ and a first reference voltage $V_{r1}$. The feedback error signal enables the first switching regulator to generate the desired high gate voltage $V_{high}$ from the regulator's input voltage $V_{in}$. The high gate voltage $V_{high}$ is generally provided to the differencer through an impedance which is represented in FIG. 5 with a resistor 96. In a similar arrangement, the second switching regulator 94 includes a differencer 97 that provides a feedback error signal as the difference between the low gate voltage $V_{low}$ and a second reference voltage $V_{r2}$ wherein the low gate voltage $V_{low}$ is provided to the differencer through a resistor 98.

The temperature-compensation network 80 of FIG. 4 is arranged in FIG. 5 to pull its second compensation current 85 out of the differencer 95 which essentially acts as a current summing point. The feedback control of the first switching regulator will maintain the voltage at the bottom of the resistor 96 substantially equal to the reference voltage $V_{r1}$. To do this it inserts a current through the resistor 96 that substantially nulls out the effect of the second compensation current 85.

The temperature-compensation network 80 is also arranged in FIG. 5 to push its first compensation current 22 into the differencer 95. In order to maintain the voltage at the top of the resistor 98 substantially equal to the reference voltage $V_{r1}$, the network 80 pulls a current through the resistor 98 that substantially nulls out the effect of the first compensation current 22.

Because of the current through the resistor 96, the amplitude of the high gate voltage $V_{high}$ increases (e.g, from +25V to +35V) with decreases in temperature. Because of the current through the resistor 98, the amplitude of the low gate voltage $V_{low}$ also increases (e.g, from −10V to −20V) with decreases in temperature. These increased gate voltages are structured to substantially track the shift of threshold voltages in the thin film transistors and thereby reduce display degradation of the visual quality of the display.

The embodiments of the invention described herein are exemplary and numerous modifications, variations and rearrangements can be readily envisioned to achieve substantially equivalent results, all of which are intended to be embraced within the spirit and scope of the appended claims.

I claim:

1. A temperature-compensation network to provide a compensation current that has a selectable response to temperature, comprising:

a limit current mirror configured to provide a limit current;

a current generator configured to provide a slope current whose magnitude varies with temperature; and an output current mirror having a diode-coupled transistor coupled to receive said slope current and a mirror transistor gate-coupled to said diode-coupled transistor to provide said compensation current;

said compensation current thus varied by temperature until limited by said limit current;

wherein said output current mirror includes a second mirror transistor gate-coupled to said diode-coupled transistor and further including a second output current mirror positioned to mirror a second compensation current in response to current from said second mirror transistor wherein said mirror and second mirror transistors are of opposite polarity.

2. The network of claim 1, wherein said current generator includes:

a slope resistor;

a voltage reference that couples a reference voltage to said slope resistor;

a slope transistor coupled to drive said slope resistor; and a differential amplifier arranged to drive a control terminal of said slope transistor in response to the difference between said reference voltage and a temperature-sensitive voltage to, thereby, generate said slope current in said slope transistor.

3. The network of claim 2, further including a temperature transducer configured to provide said temperature-sensitive voltage.

4. The network of claim 3, wherein said temperature transducer includes:

a current source to provide a current; and a temperature-sensitive impedance arranged to receive said current and provide said temperature-sensitive voltage.

5. The network of claim 4, wherein said temperature-sensitive impedance includes a thermistor and at least one resistor coupled in a selected one of series and parallel arrangements with said thermistor.

6. The network of claim 1, wherein said limit current mirror includes:

a limit resistor;

a limit diode-coupled transistor coupled to drive a bias current through said limit resistor; and a limit mirror transistor gate-coupled to said limit diode-coupled transistor to thereby provide said limit current;

selection of said limit resistor thereby establishing said limit current.

7. The network of claim 6, further including a differential amplifier inserted to drive a control terminal of said limit diode-coupled transistor in response to the difference between a reference voltage and a voltage across said limit resistor.

8. A panel driver for a liquid crystal display that has pixels arranged in rows; comprising:

a first switching regulator configured to generate a first gate voltage in response to the difference at a first differencer between said first gate voltage and a first reference voltage;

a second switching regulator configured to generate a second gate voltage in response to the difference at a second differencer between second gate voltage and a second reference voltage;

row driver logic configured to apply said first gate voltage to sequentially-selected ones of said rows while applying said second gate voltage to the others of said rows; and a temperature-compensation network to provide first and second compensation currents respectively to said first and second differencers wherein said network includes:

a limit current mirror configured to provide a limit current;

a current generator configured to provide a slope current whose magnitude varies with temperature; and a first output current mirror positioned to receive said limit current and having a diode-coupled transistor coupled to receive said slope current, having a first mirror transistor gate-coupled to said diode-coupled transistor to mirror said first compensation current, and having a second mirror transistor gate-coupled to said diode-coupled transistor to mirror an intermediate current; and a second output current mirror to mirror said second compensation current in response to said intermediate current.

9. The driver of claim 8, wherein at least one of said first and second switching regulators are configured as a selected one of a charge pump regulator and a buck-boost switching regulator.

10. The driver of claim 8, wherein said current generator includes:

a slope resistor;

a voltage reference that couples a reference voltage to said slope resistor;

a slope transistor coupled to drive said slope resistor; and a differential amplifier arranged to drive a control terminal of said slope transistor in response to the difference between said reference voltage and a temperature-sensitive voltage to, thereby, generate said slope current in said slope transistor.

11. The driver of claim 10, further including a temperature transducer configured to provide said temperature-sensitive voltage.

12. The driver of claim 11, wherein said transducer includes:

a current source to provide a current; and a temperature-sensitive circuit arranged to receive said current and provide said temperature-sensitive voltage.

13. The driver of claim 8, wherein said limit current mirror includes:

a limit resistor;

a limit diode-coupled transistor coupled to drive a bias current through said limit resistor; and a limit mirror transistor gate-coupled to said limit diode-coupled transistor to thereby provide said limit current;

selection of said limit resistor thereby establishing said limit current.

14. The driver of claim 13, further including a differential amplifier inserted to drive a control terminal of said limit diode-coupled transistor in response to the difference between a reference voltage and a voltage across said limit resistor.

* * * * *